US009889973B2

(12) United States Patent
Seo et al.

(10) Patent No.: US 9,889,973 B2
(45) Date of Patent: Feb. 13, 2018

(54) STORAGE CONTAINER AND REFRIGERATOR HAVING THE SAME

(71) Applicant: SAMSUNG ELECTRONICS CO., LTD., Suwon-si, Gyeonggi-do (KR)

(72) Inventors: Yong Bum Seo, Hwaseong-si (KR); Jung-Geun Lee, Gwangju (KR); Kang Il Song, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/824,523

(22) Filed: Aug. 12, 2015

(65) Prior Publication Data

US 2016/0054050 A1 Feb. 25, 2016

(30) Foreign Application Priority Data

Aug. 25, 2014 (KR) ..... 10-2014-0110811

(51) Int. Cl.

| | |
|---|---|
| ***G01N 21/75*** | (2006.01) |
| ***B65D 43/02*** | (2006.01) |
| ***F25D 17/04*** | (2006.01) |
| ***F25D 29/00*** | (2006.01) |
| ***B65D 81/24*** | (2006.01) |
| *B65D 45/24* | (2006.01) |

(52) U.S. Cl.

CPC ..... *B65D 43/02* (2013.01); *B65D 81/24* (2013.01); *F25D 17/042* (2013.01); *F25D 29/005* (2013.01); *B65D 45/24* (2013.01); *B65D 2203/10* (2013.01); *F25D 2700/00* (2013.01)

(58) Field of Classification Search

CPC ..... B65D 43/02; B65D 81/24; B65D 25/54; B65D 51/245; B65D 45/24; B65D 2203/10; F25D 29/005; F25D 17/042; F25D 2700/00

See application file for complete search history.

(56) References Cited

U.S. PATENT DOCUMENTS

| | | | | |
|---|---|---|---|---|
| 2,716,338 A * | 8/1955 | Blinn | ..... | G01N 31/222 116/206 |
| 3,067,015 A * | 12/1962 | Lawdermilt | ..... | 116/206 |
| 2005/0153452 A1* | 7/2005 | Williams | ..... | G01N 31/22 436/2 |

* cited by examiner

*Primary Examiner* — Dennis White
(74) *Attorney, Agent, or Firm* — Staas & Halsey LLP

(57) ABSTRACT

A storage container having a sensor unit and a refrigerator having the same. The storage container includes a container body; a container cover coupled to the container body; a sensor module disposed at least at one of the container body or the container cover; and a coupling member provided as to accommodate at least a portion of the sensor module, and detachably coupled to at least one of the container body or the container cover. The sensor unit is detachably coupled to the storage container, and thus a replacement of the sensor unit may be easily performed.

16 Claims, 10 Drawing Sheets

STORAGE CONTAINER AND REFRIGERATOR HAVING THE SAME

CROSS-REFERENCE TO RELATED APPLICATIONS

This application claims the priority benefit of the Korean Patent Application No. 10-2014-0110811, filed on Aug. 25, 2014, in the Korean Intellectual Property Office, the disclosure of which is incorporated herein by reference.

BACKGROUND

1. Field

Embodiments of the present disclosure relate to a storage container and a refrigerator having the same, and more particularly, a storage container provided with a sensor unit (sensor), and a refrigerator having the same.

2. Description of the Related Art

In general, a refrigerator is an apparatus configured to store foods at a lower temperature. The refrigerator includes a freezing compartment in which foods are stored at a relatively lower temperature, and a refrigerating compartment in which foods are stored at a relatively higher temperature.

Cool air being supplied to the freezing compartment and the refrigerating compartment may be generated by use of heat-exchanging action of refrigerant. The refrigerant may be able to heat-exchange with respect to air while repeatedly circulating a refrigerant cycle of compression, condensation, expansion, and evaporation. The foods at an inner side the refrigerator may be stored at a desired temperature by supplying the air, having heat-exchanged with respect to the refrigerant, through a circulation fan.

The foods stored at an inner side the refrigerator as such may be decomposed or ripen according to characteristics of the each food. Various types of gases may be generated at the time of the ripening or the decomposition of the foods. For example, gases such as acetic acid, aldehyde acid, sulfur compounds, and alcohol may be generated at the time of when Kimchi is being ripe.

The degree of decomposition or ripening of the foods may be measured by use of a sensor module configured to measure subject gases, among the various gases that are being generated, that are considered indicators of the decomposition or the ripening of the foods. Therefore, various types of refrigerators having the sensor module are recently under development. However, the sensor module is required to be periodically replaced, and thus difficulty may be present in installing such.

SUMMARY

Therefore, it is an aspect of the present disclosure to provide a storage container having a sensor unit (sensor) detachably coupled to a storage body and the storage container.

It is another aspect of the present disclosure to provide a storage container having a sensor module configured to have colors thereof changed according to the status (condition) of stored foods, and configured to display the changed colors of the sensor module.

Additional aspects of the disclosure will be set forth in part in the description which follows and, in part, will be apparent from the description, or may be learned by practice of the disclosure.

In accordance with one aspect of the present disclosure, a storage container includes a container body, a sensor module, and a coupling member. The container cover may be coupled to the container body. The sensor module may be disposed on at least one of the container body and the container cover. The coupling member may be provided as to accommodate at least a portion of the sensor module, and detachably coupled to the at least one of the container body and the container cover.

The coupling member may be rotatably detached from at least one of the container body and the container cover.

The coupling member may include a coupling protrusion extending in the shape of a spiral.

The at least one of the container body and the container cover may include a guide protrusion configured to guide the coupling protrusion.

The at least one of the container body and the container cover may include a concavo-convex container structure such that the coupling member is rotated and then fixed to a predetermined position, and the coupling member may include a concavo-convex coupling structure corresponding to the concavo-convex container structure.

The at least one of the container body and the container cover may include a coupling accommodation unit, and the coupling member may include a coupling insertion unit being inserted into the coupling accommodation unit.

The coupling insertion unit may include a coupling protrusion extendedly formed in the shape of a spiral, and the coupling accommodation unit may include a guide protrusion configured to guide the coupling protrusion such that the coupling insertion unit is rotated and then inserted into the coupling accommodation unit.

A sensor accommodation unit at which the sensor module is accommodated may be provided at an inner side of the coupling insertion unit.

The coupling member may include a sensor accommodation unit at which the sensor module is accommodated, and as to protect the sensor module accommodated at the sensor accommodation unit, the coupling member may further include a sensor cover coupled to one side of the sensor accommodation unit.

The sensor cover may be coupled to one side of the sensor accommodation unit, such that the sensor module is fixed to the sensor accommodation unit.

The sensor module may be detached together with the coupling member from the at least one of the container body and the container cover.

A sealing member may be disposed in between the at least one of the container body and the container cover and the coupling member.

A food accommodation unit may be formed as the container body and the container cover is coupled with respect to each other; and the coupling member may be coupled to an inner side surface of the at least one of the container body and the container cover such that the sensor module is positioned at the food accommodation unit.

The sensor module may be provided such that the colors thereof are changed according to the amount of subject gases, and the sensor module may be provided such that the color changes of the sensor module are displayed at an exterior appearance of the container body and the container cover.

At an exterior appearance of the container body and the container cover at which the color changes of the sensor module are displayed, color samples showing the colors of the sensor module that correspond to different status of the foods being accommodated at the food accommodation unit may be provided.

In accordance with another aspect of the present disclosure, a storage container includes a container body, a container cover and a sensor unit. The container cover may be coupled to the container body as to form a food accommodation unit. The sensor unit may be provided as to display status of foods being accommodated at the food accommodation unit, and detachably coupled to one side of the container cover.

The sensor unit may include a sensor module configured to change colors thereof according to the status of the accommodated foods, and a coupling member provided as to accommodate the sensor module.

The sensor unit may be detachably coupled to an inner side surface of the container cover.

The sensor unit may be installed at an outer side surface of the container cover as to display the status of the foods accommodated at the food accommodation unit.

In accordance with another aspect of the present disclosure, a refrigerator includes a body, a storage compartment, and at least one storage container. The storage compartment may be formed in the body. The at least one storage container may be provided to accommodate food therein, and disposed in the storage compartment, wherein the at least one storage container may include: a sensor module disposed at an inner side of the at least one storage container status of the accommodated foods is measured; and a display unit disposed at an outer side of the at least one storage container such that the status of the foods being measured by the sensor module is displayed.

The sensor module may be provided with colors thereof changed according to the status of the accommodated foods.

At least a portion of the display unit may be provided in transparent material such that the color changes of the sensor module are displayed at an exterior appearance of the at least one storage container.

The refrigerator may further include color samples showing the colors of the sensor module that correspond to different status of the foods being accommodated.

The color samples may be adjacently disposed with respect to the display unit.

A sensor unit may be detachably coupled to a storage container, and thus a replacement of the sensor unit may be easily conducted.

In addition, the sensor unit is capable of providing convenience while disposed at an inner side the storage container as to accurately measure the status of food, and also while configured to display at an exterior appearance of the storage container of the status of the accommodated food.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
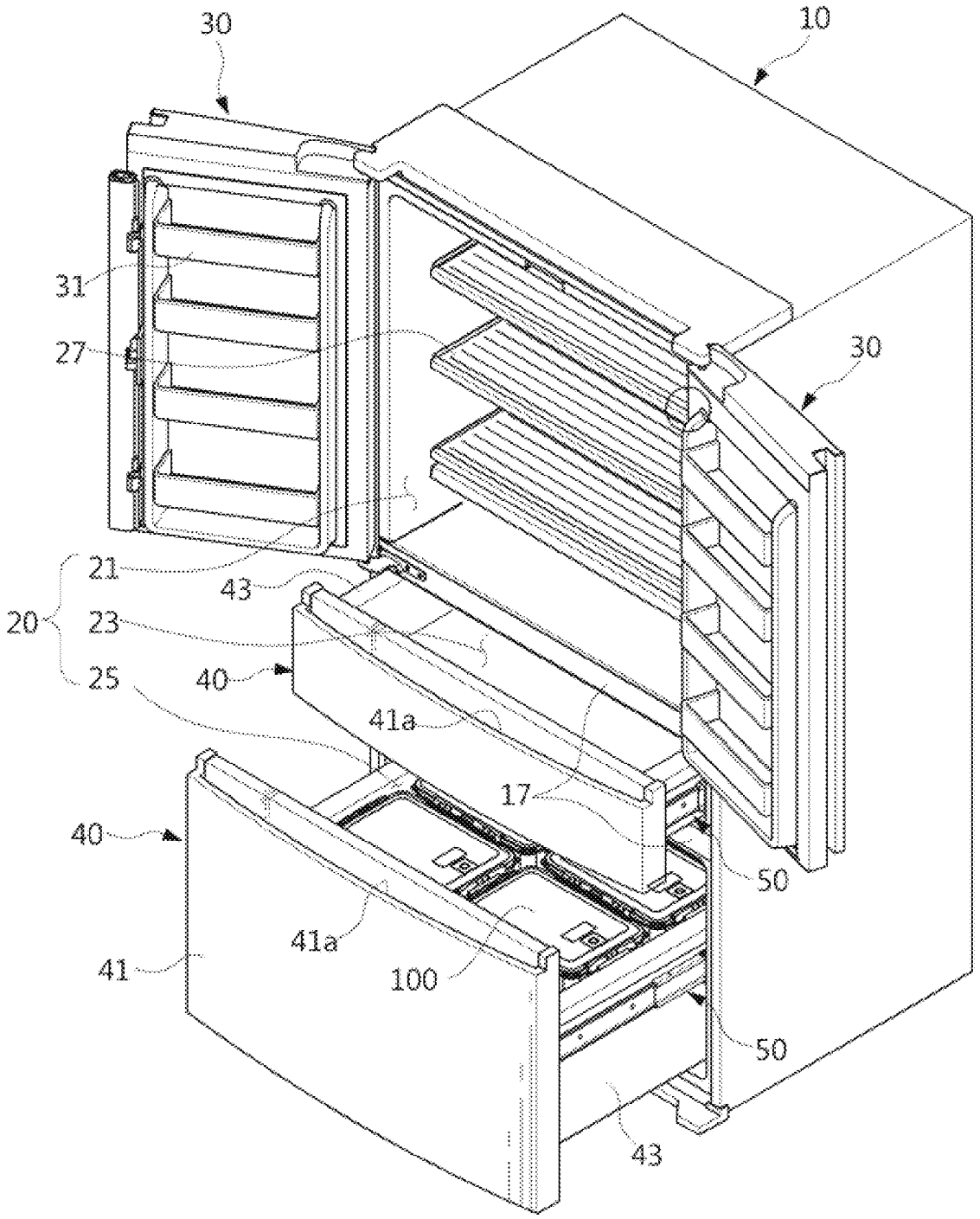
FIG. 1 is a drawing illustrating a refrigerator in accordance with an embodiment of the present disclosure.

Reference will now be made in detail to embodiments of the present disclosure, examples of which are illustrated in the accompanying drawings, wherein like reference numerals refer to like elements throughout.

Figure 2:
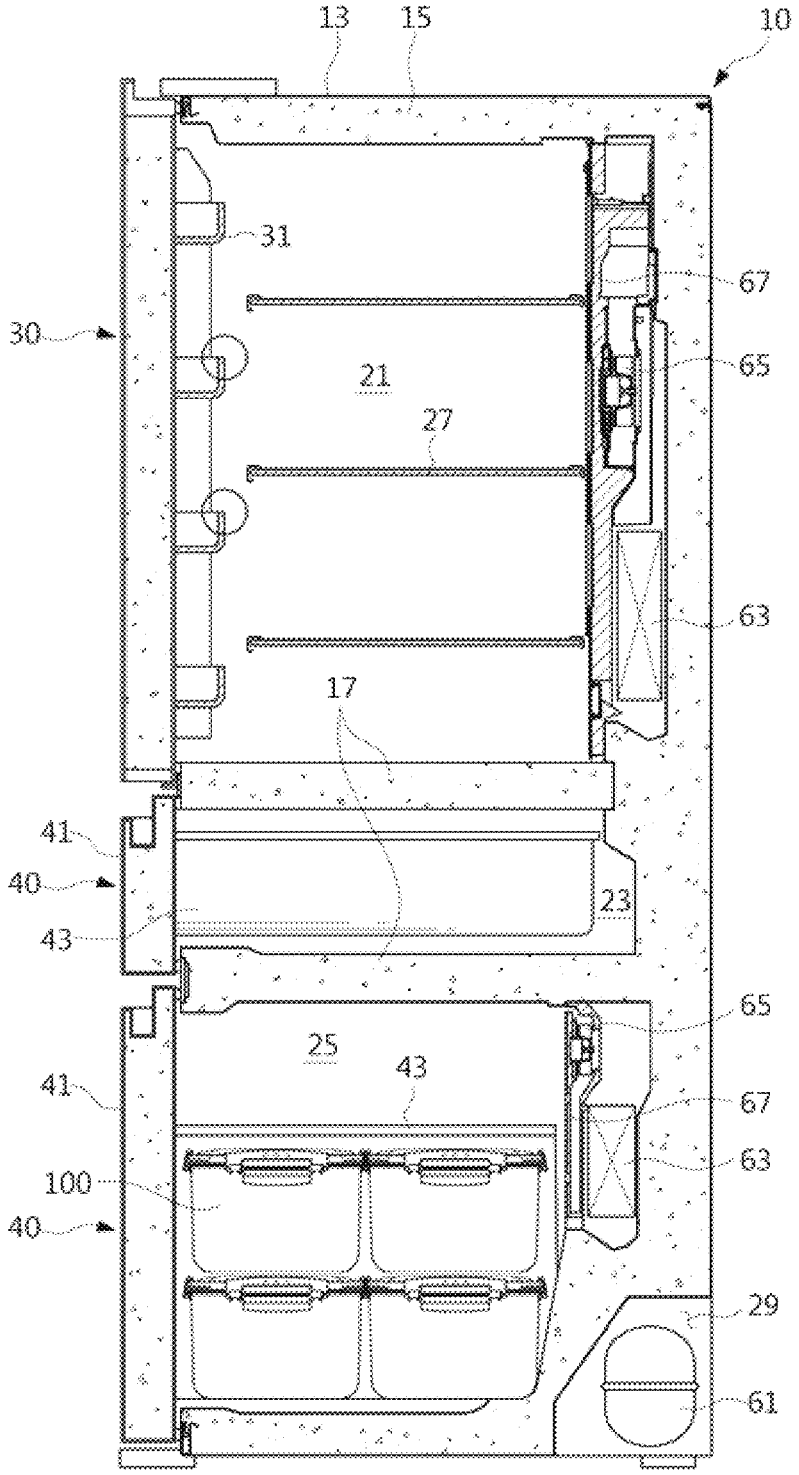
FIG. 2 is a drawing illustrating a side cross-sectional view of the refrigerator in accordance with an embodiment of the present disclosure.

FIG. 1 is a drawing illustrating a refrigerator in accordance with an embodiment of the present disclosure, and FIG. 2 is a drawing illustrating a side cross-sectional view of the refrigerator in accordance with an embodiment of the present disclosure.

As illustrated on FIG. 1 and FIG. 2, a refrigerator includes a body 10, and a storage compartment 20 formed at the body 10. The storage compartment 20 may be provided in a plurality of units such that a front surface thereof is open at an inner side the body 10.

In addition, the refrigerator includes a door 30 rotatably coupled to the body 10 as to open/close the open front surface of the storage compartment 20, a storage unit 40 configured to be inserted into and withdrawn from by a sliding method while stored at the storage compartment 20, and a sliding apparatus 50 configured to guide the storage unit 40 to be inserted into and withdrawn from by a sliding method.

The body 10 may include an inner case 11 forming the storage compartment 20 and an outer case 13 forming an exterior appearance. Insulation material 15 is foamed in between the inner case 11 and the outer case 13 as to prevent a leak of cool air of the storage compartment 20.

In addition, the body 10 includes a cool air supplying apparatus configured to supply cool air at the storage compartment 20. The cool air supplying apparatus may include a compressor 61, a condenser (not shown), an expansion valve (not shown), an evaporator 63, a draft fan 65, and a cool air duct 67. A machinery compartment 29 at which the compressor 61 and the condenser (not shown) configured to compress refrigerant and condense the compressed refrigerant, respectively, are installed is provided at a lower rear side of the body 10.

The evaporator 63, the draft fan 65, and the cool air duct 67 are disposed at a rear wall of the storage compartment 20, and the each of the evaporator 63, the draft fan 65, and the cool air duct 67 may be provided in plurality. The evaporator 63 is configured to generate cool air, the draft fan 65 is configured to lead the cool air generated at the evaporator 63 to the storage compartment 20, and the cool air duct 67 is configured to guide the cool air generated at the evaporator 63 to the storage compartment 20.

The storage compartment 20 is divided in a plurality of units by use of partition walls 17, and may be vertically and sequentially divided into an upper compartment 21, a middle compartment 23, and a lower compartment 25. The each storage compartment 20 is configured to store foods refrigerated or frozen. In addition, at the each storage compartment 20, a storage container 100 provided as to accommodate foods may be disposed. The each storage compartment 20 as such will be described later.

The upper compartment 21 may be divided in a plurality of units as a plurality of shelves 27 is provided at the upper compartment 21. The upper compartment 21 may be open/closed by use of the door 30 rotatably coupled to with respect to the body 10.

The middle compartment 23 and the lower compartment 25 each may be open/closed by the storage unit 40 capable of slidingly moving with respect to the body 10. The storage unit 40 includes a drawer-type door 41, and an accommodation container 43 mounted at a lower surface of the drawer-type door 41, and a handle 41*a* a user may grasp may be provided at the drawer-type door 41.

The accommodation container 43 may be provided as to be integrally formed with respect to the drawer-type door 41, or may be separately manufactured with respect to the drawer-type door 41 as to be coupled to the drawer-type door 41.

The storage unit 40 is inserted into and withdrawn from inner sides the middle compartment 23 and the lower compartment 25 by sliding method by use of the sliding apparatus 50. The sliding apparatus 50 configured to slidingly move the storage unit 40 is provided with one side thereof coupled to each of the both side surfaces of an inner side the lower compartment 25 at which the storage unit 40 is accommodated, while the other side thereof coupled to each of the both side surfaces of the accommodation container 43 of the storage unit 40.

On the drawing, the other side of the sliding apparatus 50 is illustrated to be coupled to the both side surfaces of the accommodation container 43 of the storage unit 40. However, the other side of the sliding apparatus 50 may be structured to be coupled to a lower surface of the drawer-type door 41 instead of the both side surfaces of the accommodation container 43, such that the sliding apparatus 50 may be structured to support the accommodation container 43.

As described above, the storage container 100 is provided as to accommodate foods, and may be disposed at the each storage compartment 20. The storage container 100 may be provided in a plurality of units, and may be provided in various shapes. Hereinafter, the storage container 100 in accordance with an embodiment of the present disclosure will be described.

Figure 3:
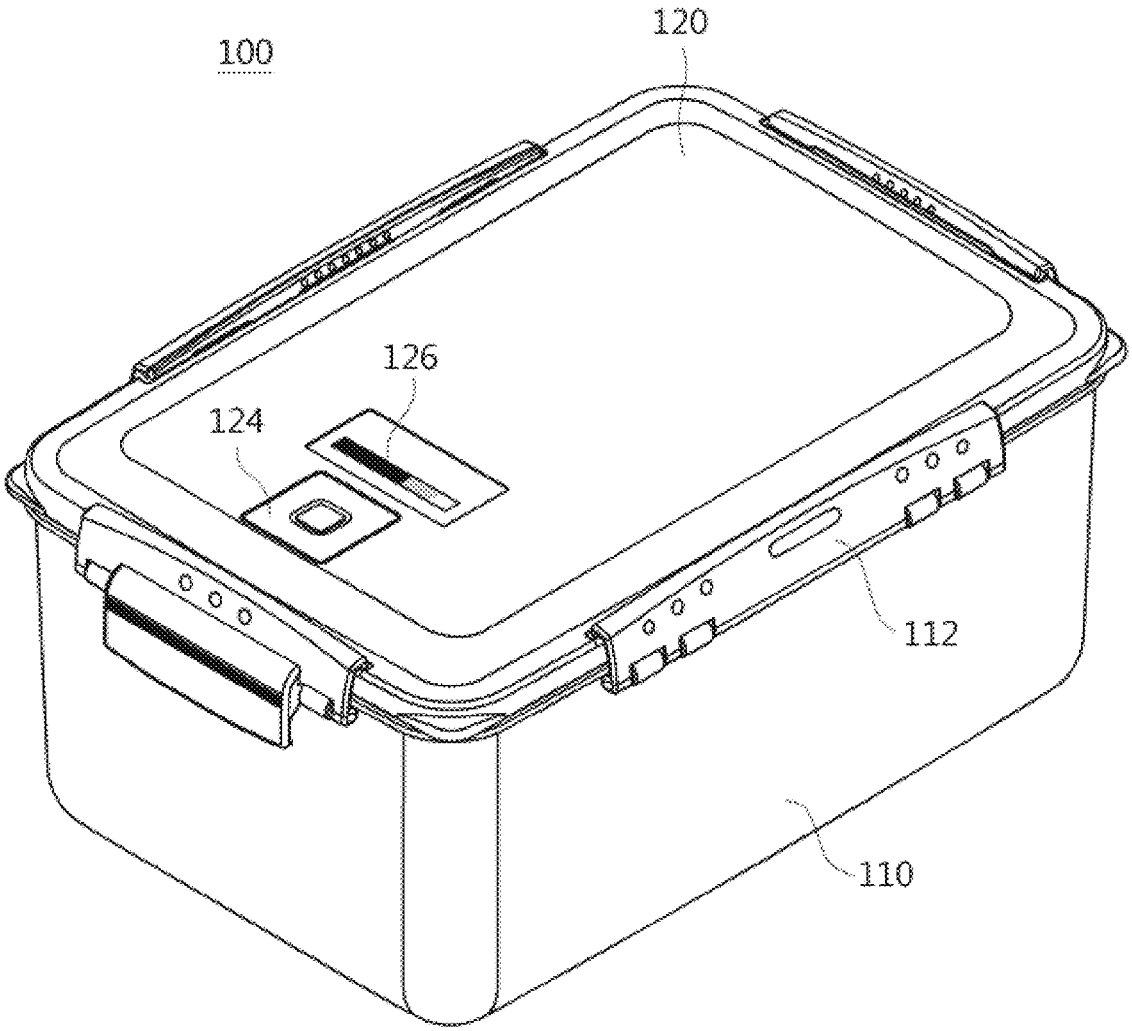
FIG. 3 is a drawing illustrating a storage container in accordance with an embodiment of the present disclosure.
Figure 4:
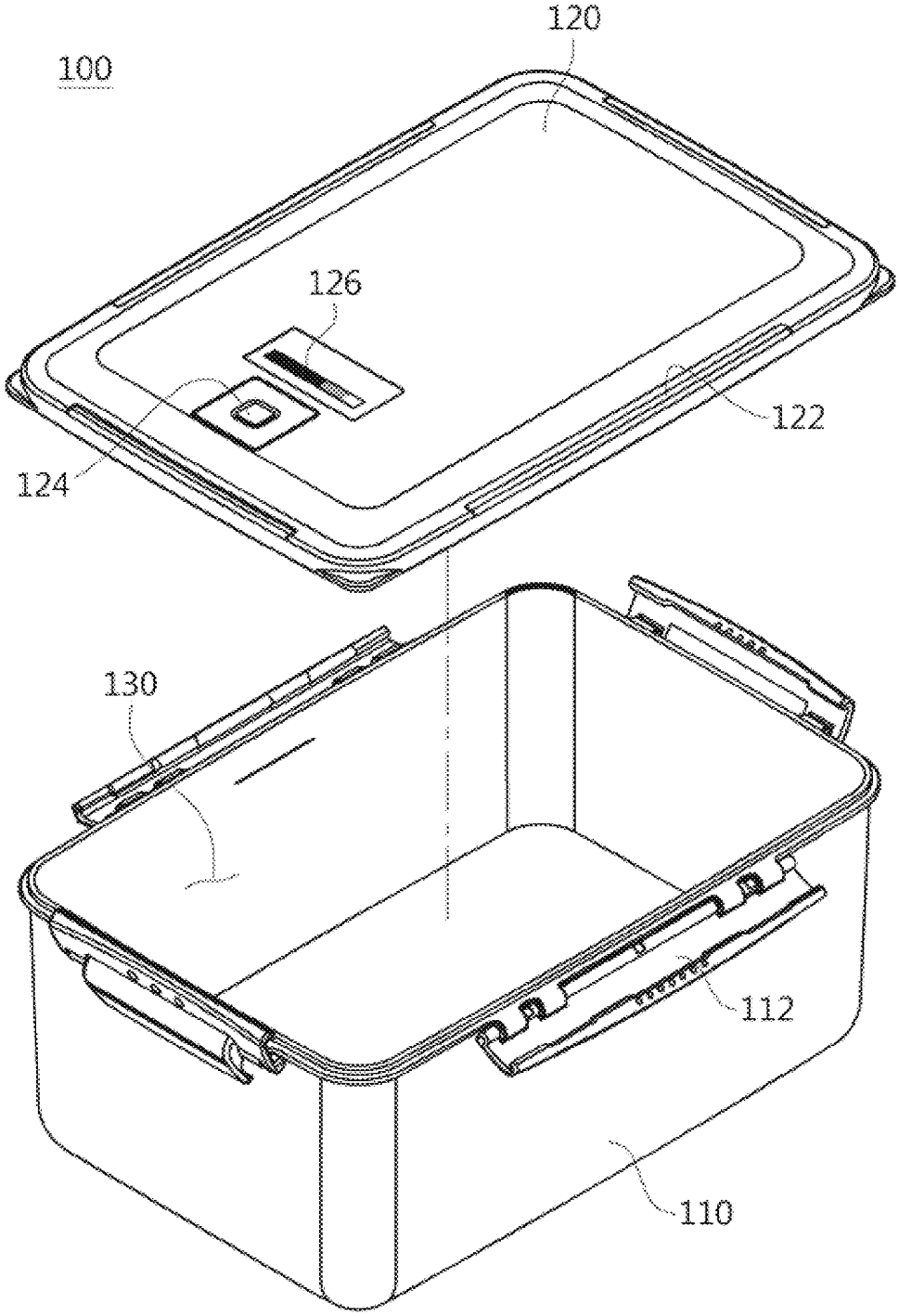
FIG. 4 is a drawing illustrating disassembled container body and container cover of the storage container in accordance with an embodiment of the present disclosure.

FIG. 3 is a drawing illustrating a storage container in accordance with an embodiment of the present disclosure, and FIG. 4 is a drawing illustrating disassembled container body and container cover of the storage container in accordance with an embodiment of the present disclosure.

The storage container 100 may include a container body 110, and a container cover 120 being coupled to the container body 110. The container body 110 may be provided such that an upper portion thereof is open as to accommodate foods. The container cover 120 may be able to form a food accommodation unit 130 by covering the upper portion of the container cover 110.

As for a user to accommodate foods at the food accommodation unit 130 or to withdraw foods from the food accommodation unit 130, the container cover 120 may be detachably coupled to the container body 110. At least one of the container cover 120 and the container body 110 may include a container coupling unit 112 configured to couple the container cover 120 and the container body 110 into each other.

As illustrated on FIG. 4, the container body 110 includes the plurality of container coupling units 112. The container coupling unit 112 is rotatably provided at an upper end portion of the container body 110, and may be coupled to the container cover 120 by use of a hook method. In addition, the container coupling unit 112 may be used as a handle configured to be used for a user to grasp the storage container 100.

The container cover 120 may include a container groove 122 into which at least a portion of the container coupling unit 112 is inserted. The food accommodation unit 130 may be formed, as the container coupling unit 112 is inserted into the container groove 112 and as the container body 110 and the container cover 120 are coupled to each other.

The container coupling unit 112 which is described above is provided as one example, and the container body 110 and the container cover 120 may be coupled to in various shapes. As illustrated on FIG. 3 and FIG. 4, a display unit 124 and color samples 126 may be provided at the container cover 120, and the display unit 124 and the color samples 126 will be described later.

Figure 5:
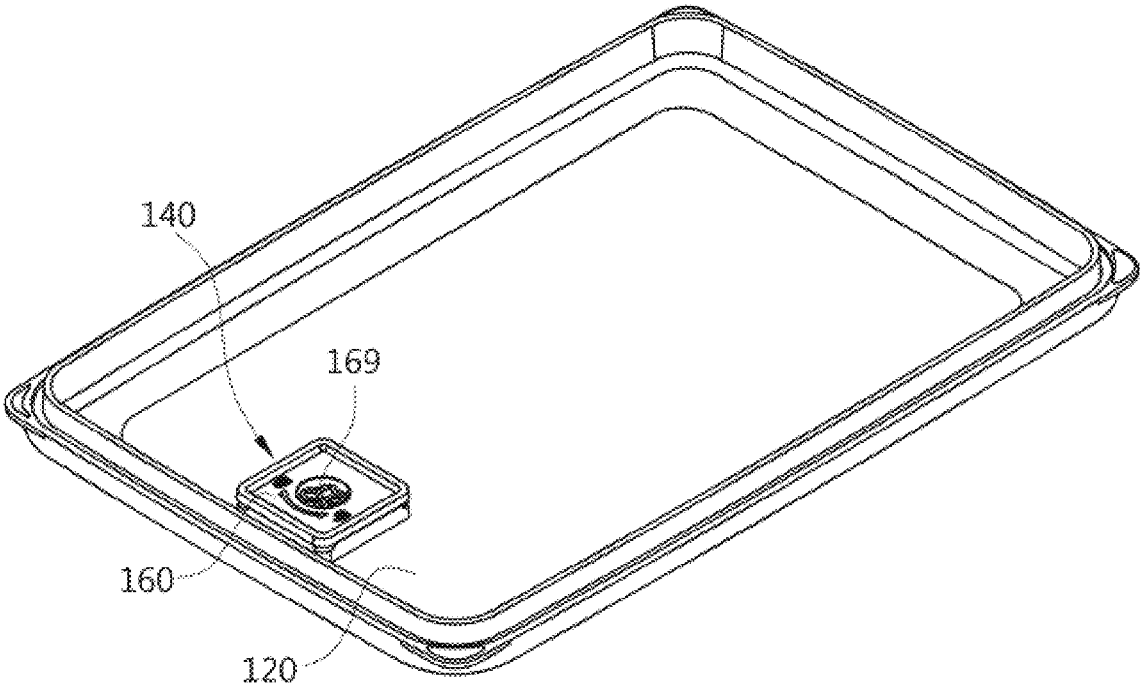
FIG. 5 is a drawing illustrating the container cover of the storage container in accordance with an embodiment of the present disclosure.

FIG. 5 is a drawing illustrating the container cover of the storage container in accordance with an embodiment of the present disclosure. FIG. 5 is referred to as a drawing illustrating a rear surface of the container cover that is adjacent with respect to the food accommodation unit.

The storage container 100 may include a sensor unit (sensor) 140 disposed to at least one of the container body 110 and the container cover 120. Hereinafter, a case of the sensor unit 140 being disposed at the container cover 120 will be described in detail, and the case may be applied to a case when the sensor unit 140 is disposed at the container body 110 or to a case when the sensor unit 140 is disposed at the container body 110 and the container cover 120.

The sensor unit 140 may be detachably coupled to one side of the container cover 120. Accordingly, a user may be able to separate and replace the sensor unit 140 from the container cover 120.

The sensor unit 140 may include a sensor module 150 (FIG. 9) and a coupling member (coupler) 160 provided as to accommodate at least a portion of the sensor module 150. In addition, a sensor cover 180 (FIG. 8) coupled to the coupling member 160 as to protect the sensor module 150. From FIG. 4 to FIG. 8, the sensor module 150 accommodated at the coupling member 160 is not illustrated.

Hereinafter, a coupling of the sensor unit 140 and the container cover 120 will be described in detail.

Figure 6:
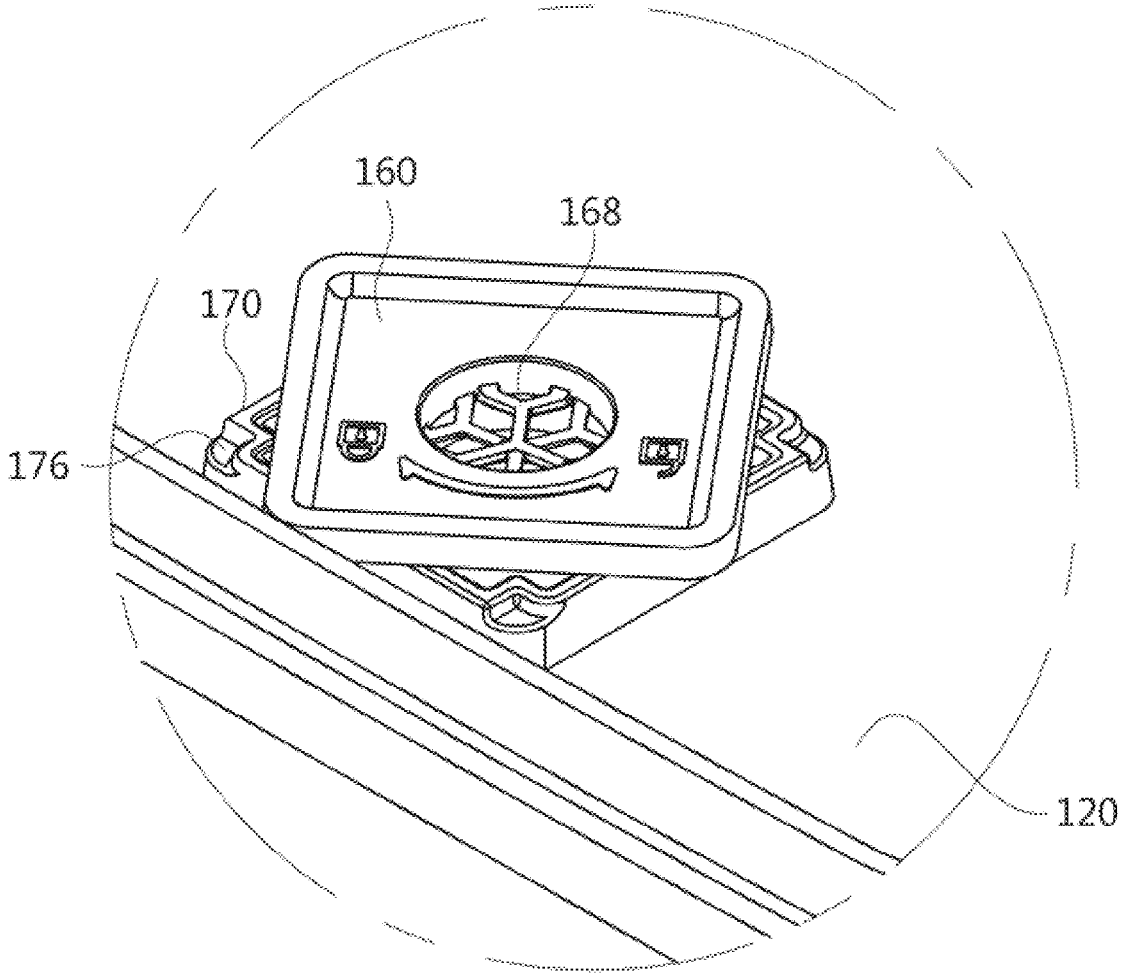
FIG. 6 is a drawing illustrating the container cover and a sensor unit of the storage container in accordance with an embodiment of the present disclosure.
Figure 7:
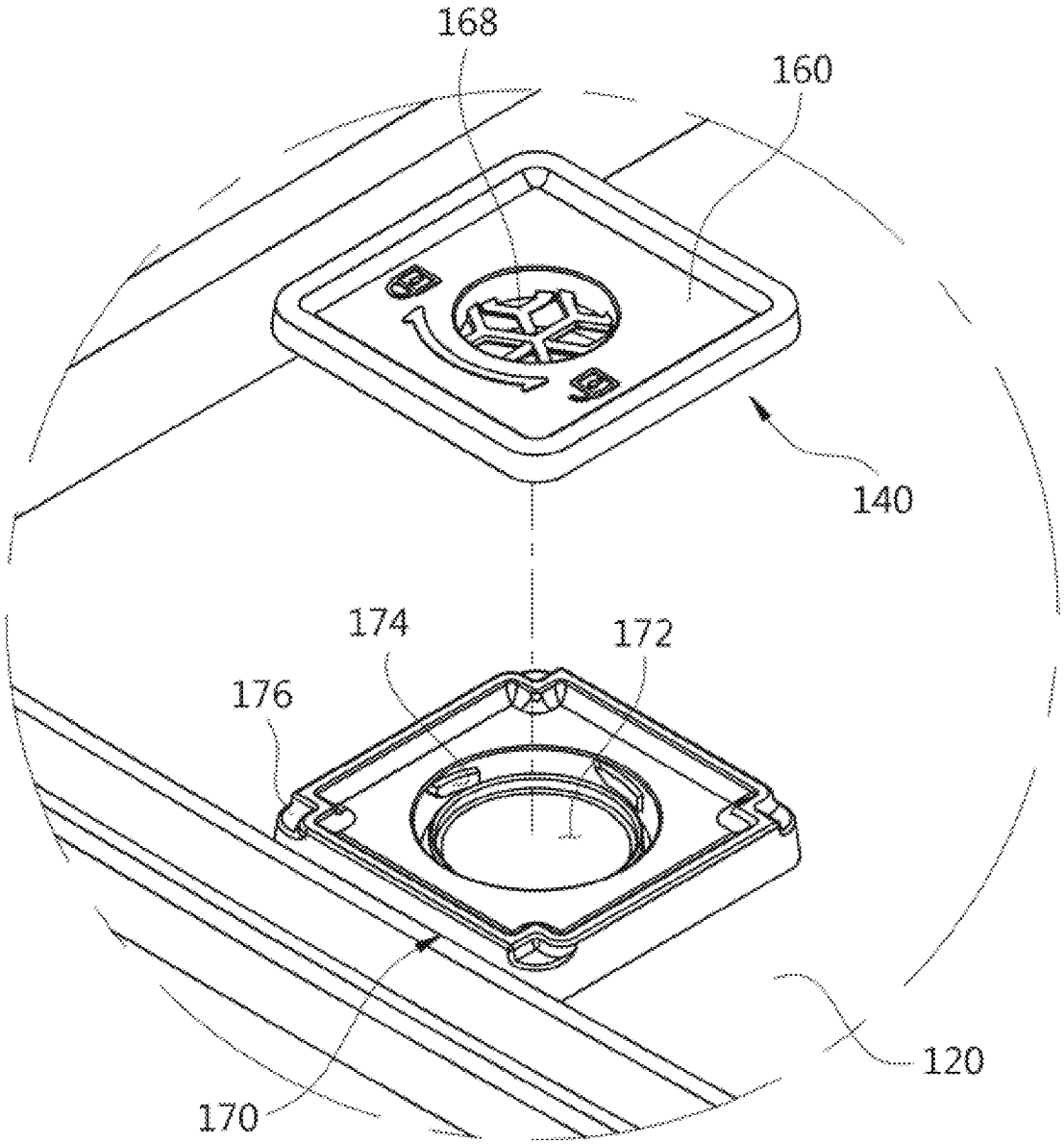
FIG. 7 is a drawing illustrating the disassembled storage cover and the sensor unit of the storage container in accordance with an embodiment of the present disclosure.

FIG. 6 is a drawing illustrating the container cover and a sensor unit of the storage container in accordance with an embodiment of the present disclosure, and FIG. 7 is a drawing illustrating the disassembled storage cover and the sensor unit of the storage container in accordance with an embodiment of the present disclosure.

As described above, the sensor unit 140 is detachably coupled to the container cover 120. As illustrated on FIGS. 5 to 7, the sensor unit 140 may be able to be coupled to a inner side surface of the container cover 120. A settling member (a receiving member) 170 into which the sensor unit 140 is coupled may be provided at an inner side surface of the container cover 120.

In detail, the coupling member 160 forming an exterior of the sensor unit 140 is detachably coupled to the settling member 170. The coupling member 160 and the settling member 170 may be provided in the shapes corresponding with respect to each other.

The settling member 170 includes a coupling accommodation unit 172 depressedly formed, and the coupling member 160 may include a coupling insertion unit 162 (FIG. 8) being inserted into the coupling accommodation unit 172. The coupling insertion unit 162 may be rotatably coupled to or rotatably separated with respect to the coupling accommodation unit 172. That is, as illustrated on FIG. 6, th sensor unit 140 may be rotatably provided at the container cover 120.

The coupling member 160 may include a coupling protrusion 164 extendedly formed in the shape of, for example, a spiral. The coupling protrusion 164 may be formed at an outer side of the coupling insertion unit 162. The container cover 120 may include a guide protrusion 174 configured to guide the coupling protrusion 164. The guide protrusion 174 is formed at an inner side of the coupling accommodation unit 172, and may be skewedly disposed such that the coupling protrusion 164 may be rotatably inserted into.

At least a portion of the coupling member 160 may be rotatably inserted into the container cover 120 by use of the coupling protrusion 164 that is rotatably inserted along with the guide protrusion 174. As for the coupling member 160 to be rotatably fixed to a predetermined position, the container cover 120 and the coupling member 160 may include a concavo-convex container structure 176 and a concavo-convex coupling structure 166, respectively.

As illustrated on FIG. 7, the concavo-convex container structure 176 may be formed at an edge of the settling member 170. The concavo-convex container structure 176 may be provided in the shape of a depressed groove, and the concavo-convex coupling structure 166 may be provided in the shape of a protrusion that corresponds with respect the shape of a depressed groove.

Thus, the coupling insertion unit 163 is correspondingly disposed at the coupling accommodation unit 172, and the coupling protrusion 164 is rotated along the guide protrusion 174. The coupling member 160 is fixed to the settling member 170 as the concavo-convex coupling structure 166 is inserted into the concavo-convex container structure 176.

Figure 8:
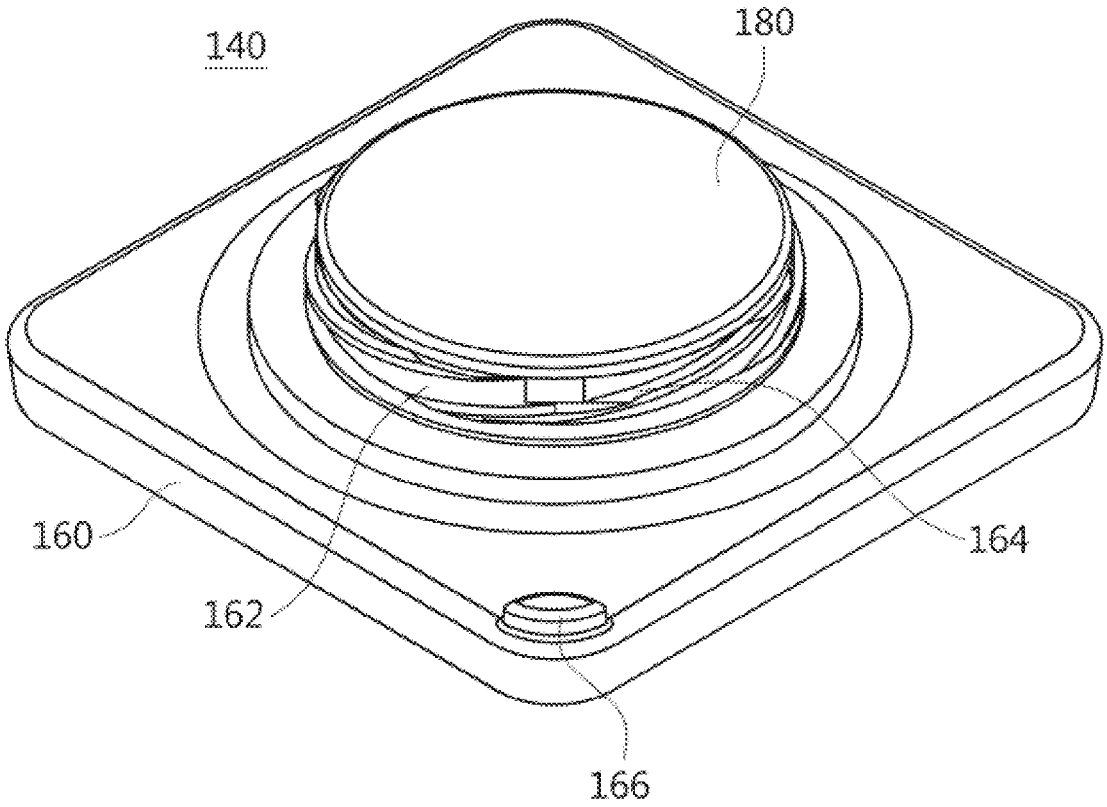
FIG. 8 is a drawing illustrating the sensor unit of the storage container in accordance with an embodiment of the present disclosure.
Figure 9:
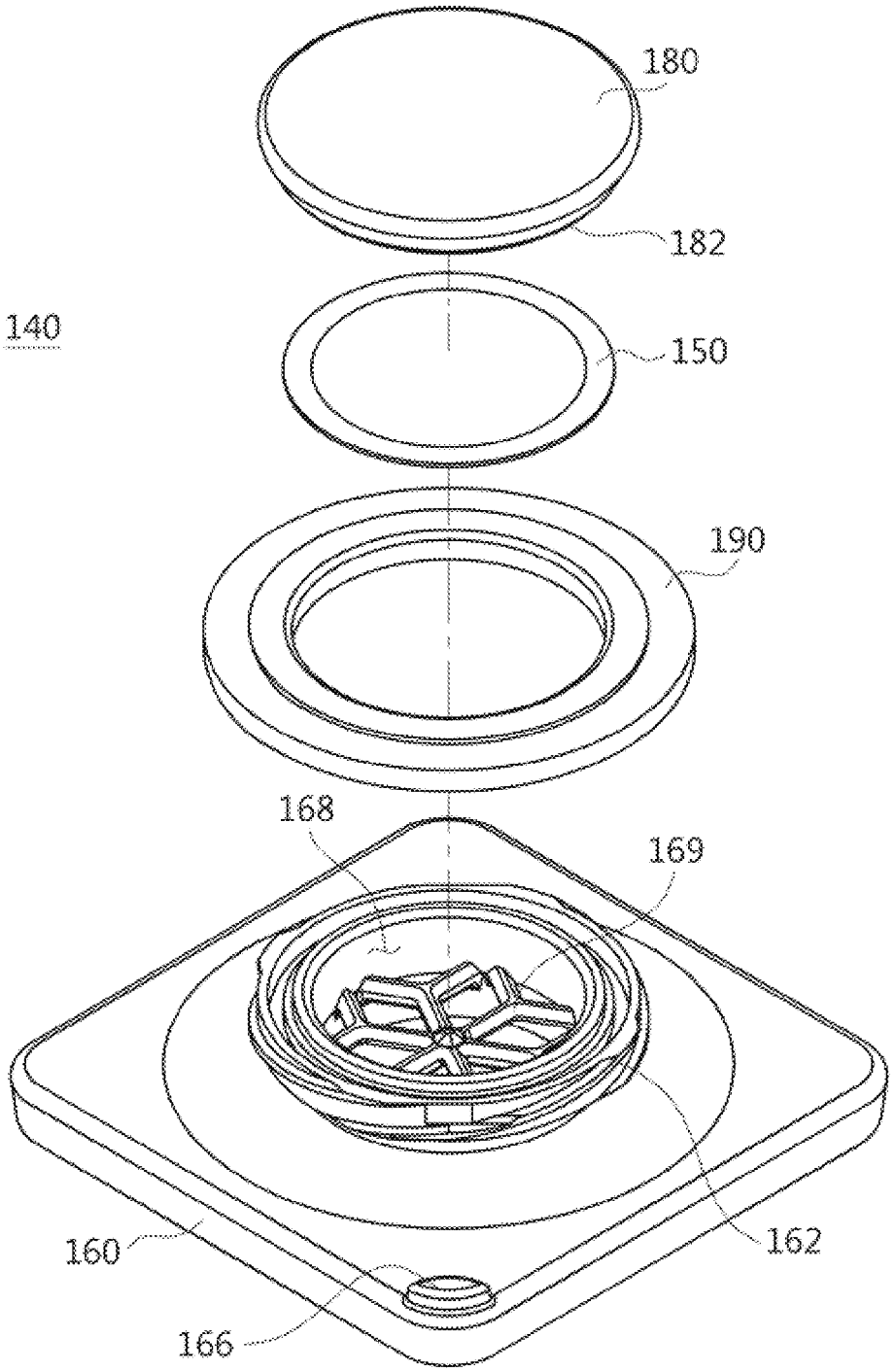
FIG. 9 is a drawing illustrating the disassembled sensor unit of the storage container in accordance with an embodiment of the present disclosure.

FIG. 8 is a drawing illustrating the sensor unit of the storage container in accordance with an embodiment of the present disclosure, and FIG. 9 is a drawing illustrating the disassembled sensor unit of the storage container in accordance with an embodiment of the present disclosure.

As describe above, the coupling member 160 is detachably coupled to the container cover 120. Accordingly, the sensor module 150 accommodated at the coupling member 160 may be detached from the container cover 120 along with the coupling member 160. Thus, a replacement and exchange of the sensor module 150 may be easily conducted.

As illustrated on FIG. 9, the sensor unit 140 may include the coupling member 160, the sensor module 150, and a sensor cover 180. In addition, the sensor unit 140 may include a sealing member (sealer) 190 configured to closely attach the container cover 120 and the sensor unit 140.

In a case when the sensor unit 140 is coupled to the container cover 120, the sealing member 190 may be disposed in between the container cover 120 and the coupling member 160. The sealing member 190 may be provided with flexible material such as rubber, and may be able to prevent the smell of foods from being delivered to an outside by reducing the gap in between the coupling member 160 and the container cover 120. The sealing member 190 may be insertedly coupled to an outer side of the coupling insertion unit 162.

A sensor accommodation unit 168 at which the sensor module 150 is accommodated may be provided at an inner side of the coupling insertion unit 162. The sensor cover 180 is capable of protecting the sensor module 150 while coupled to one side of the sensor accommodation unit 168. An insertion of foreign substance into the sensor accommodation unit 168 may be prevented by use of the sensor cover 180.

The sensor cover 180 may include a sensor cover coupling unit (a sensor cover coupler) 182 being inserted into and mounted at an inner side of the sensor accommodation unit 168. The sensor module 150 may be able to be fixed at the sensor accommodation unit 168 as the sensor cover coupling unit 182 is inserted into an inner side of the sensor accommodation unit 168.

The sensor accommodation unit 168 is provided with a side surface thereof formed by use of the coupling insertion unit 162, and is provided with one surface thereof formed by use of the sensor cover 180 while the one surface is adjacent with respect to the food accommodation unit 130. Another one surface of the sensor accommodation unit 168 that is adjacent with respect to the food accommodation unit 130 is provided with an open state, and may be provided with a frame 169 having a predetermined shape.

The frame 169 is referred to as a portion being exposed to an exterior in a case when the container cover 120 is separated from the container body 110 by a user, and may be provided in various shapes as to enhance aesthetic appearance. In addition, the frame 169 is capable of protecting the sensor module 150 from making contact with respect to foreign substance.

The sensor module 150 is configured to measure the status (condition) of foods being accommodated at the food accommodation unit 130, and may be provided as to display the status as such. For example, the sensor module 150 may be provided as a gas sensor module configured to measure particular gases. That is, the sensor module 150 is capable of measuring the status of foods by measuring the particular gases.

In a case of ripening or decomposition of foods, various types of gases are generated, and the amount and types of the generated gases are affected by the ripening of the foods and also by the seasonings and additional material that are added to the foods.

As for the elements of the gases, among the generated gases, that are closely related to the ripening of the foods are volatile organic acid and ammonia. The elements of the gases as such are not detected when foods are in fresh status while the density of the elements of the gases as such is increased in proportion to the degree of ripening as the ripening is proceeded.

For example, when Kimchi which is a type of fermented food is ripe, gases such as acetic acid, aldehyde, sulfur compounds, and alcohol are generated. At this time, the gas that is directly involved in the fermentation of the Kimchi is volatile organic acid that is generated as a by-product of micro-organism, for example, the acetic acid. The acetic acid is nearly not generated during an early period of the fermentation of the Kimchi, and is shown with gradual increase as the fermentation is proceeded.

Thus, the degree of fermentation of the Kimchi may be determined by measuring the amount of the acetic acid as such. In addition, the degree of ripening or decomposition may be determined from the elements of the gases that are generated in a case of the foods in general other than the fermented foods.

In a case of meat, amino acid is increased as protein is decomposed by use of micro-organism during a long-term, low-temperature storage period. During metabolic process, gases such as ammonia, sulfur compounds, aldehyde, and VOC (Volatile Organic Compound) are generated, and the degree of decomposition of the meat may be determined by measuring the amount of the ammonia.

Figure 10:
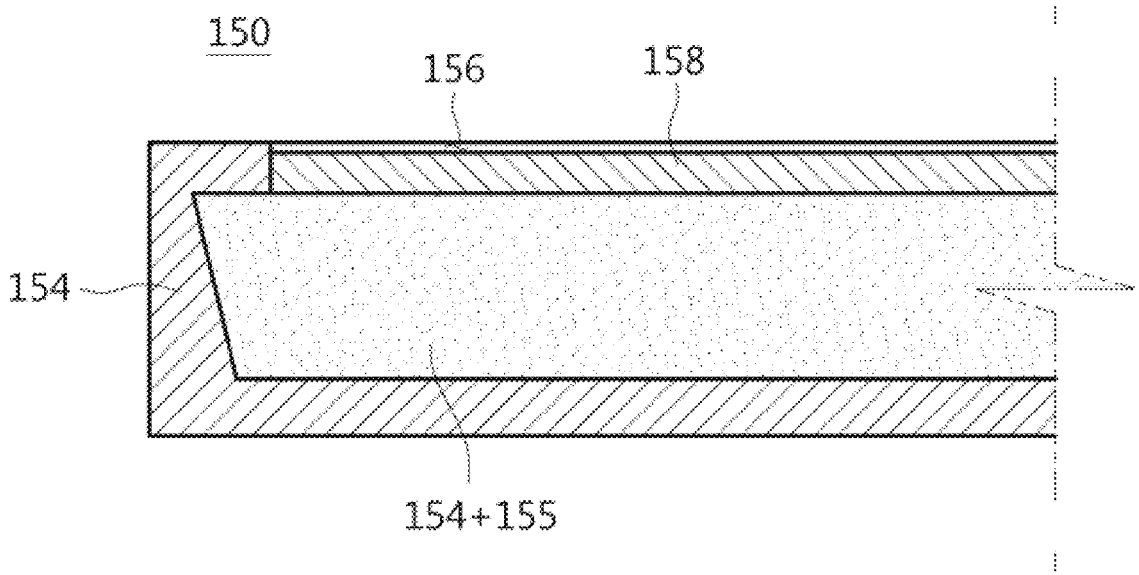
FIG. 10 is a drawing illustrating a sensor module of the storage container in accordance with an embodiment of the present disclosure.

FIG. 10 is a drawing illustrating a sensor module of the storage container in accordance with an embodiment of the present disclosure. Referring to FIG. 10, the structure and operation principle of the sensor module will be described in detail.

The sensor module 150 may include a sensor housing 152 and a solution 154 being filled at an inside the sensor housing 152.

A gas inlet unit (a gas inlet) 156 through which a subject gas to be measured may be formed at one side of the sensor housing 152. The sensor housing 152 is structured of material having no gas permeability, and glass and various resins may be used.

A porous membrane 158 provided such that outside gas elements may be easily inlet while restraining evaporation of electrolyte as much as possible may be provided at the gas inlet unit 156.

The porous membrane 158 is structured of material having gas permeability. For example, most gas-permeable resins having FEP (Fluorinated Ethylene Propylene) film, which is porous PTFE (Poly Tetra Fluoro Ethylene) film may be used.

The solution 154 is configured to perform a function of viscous layer of an epithelial tissue of a human body provided as to collect odor molecules in air. The solution 154 is capable of selectively collecting water-soluble gas.

As described above, the volatile organic acid gas or the ammonia gas may be used as significant indicators as to determine the degree of fermentation or ripening of foods. Thus, the sensor module 140 may consider the volatile organic acid gas or the ammonia gas as the subject gases. That is, the sensor module may be structured as to measure the density of the volatile organic acid gas or the ammonia gas.

The volatile organic acid gas or the ammonia gas are referred to as material having polarizability that are only water-soluble, and are capable of selectively collecting water-soluble molecules such as the volatile organic acid or the ammonia, excluding fat-soluble molecules such as the sulfur compound and the VOC, among various gas elements that are present in outside atmosphere of the sensor module 140. That is, the solution 154 is capable of performing a role in filtering most of the sulfur compound and the VOC that are generates from foods.

The volatile organic acid or the ammonia both are provided to induce density change of hydrogen ion while disassociated at the time of when dissolved in the solution 154. In a case of carboxylic acid (R—COOH), which is known to be a typical volatile organic acid, is provided to reduce the pH of the solution as hydrogen ion is generated when dissolved, and in a case of the ammonia (NH3), the pH of the solution is increased while hydrogen ion of the solution is reduced when dissolved in the solution.

The subject gas may be able to be measured by use of the changes in pH as such. The pH changes of the solution 154 may be measured by use of various methods, and for example, a pH indicator 155 provided with colors thereof changed according to the pH may be added to the solution 154.

Thus, a mixed solution of the solution 154 and the pH indicator 155 may be filled at an inside the sensor housing 152. The pH indicator 155 is provided with characteristic of changing colors thereof according to the degree of reactions with respect to the hydrogen ion in the solution.

For example, as the pH indicator 155, 3 mM of sodium acetate buffer pH 7.6 having bromothymol blue and methyl red is exposed to the acetic acid. As a result of injecting the acetic acid gas by about 1 cc, as the amount of the acetic acid gas being injected is increased, the colors of the solution are changed to blue yellow, and red.

The result, which is obtained from a case of the bromothymol blue being presented with yellow when the pH of the solution is turned to about 6.0 after the bromothymol blue is presented with blue when the pH of the solution is about 7.6, is combined with the result, which is obtained from a case of the methyl red being presented with red when the pH of the solution is turned to about 4.8 after the methyl red is presented with yellow when the pH of the solution is about 6.0.

Thus, the inside the sensor housing 152 may be filled by mixing the proper pH indicator 155 with the solution 154 depending on the type of the subject gas being measured. At this time, the mixed solution of the solution 154 and the pH indicator 155 may be present in the state of gas or in the form of gel, and may be fixed at an inside the sensor housing 152 while absorbed to fiber provided at an inside th sensor housing 152.

For example, in a case when the subject gas to be measured is the carboxylic acid, the bromothymol blue reagent in the range of about 0.001 wt % and about 0.1 wt % of the methyl red reagent in the range of about 0.001 wt % and 0.1 wt % may be independently or mixedly used.

In detail, in a case when the subject gas to be measured is acetic acid gas of the pKa of about 4.7, according to the example of the experiment above, the bromothymol blue reagent of about 0.02 wt % and the methyl red reagent of about 0.005 wt % are mixed with ethanol of about 10 wt % for reaction, and then dissolved in the solution 154. The ethanol is being used as to dissolve the pH indicator 155.

Or, in a case when the subject gas to be measured is the ammonia, thymol blue or phenolphthalein in the range of about 0.001 wt % and 0.1 wt % may be used, and in a case when a lower density of the ammonia is to be measured, cresol red or the bromothymol blue having similar density level may be used either independently or mixedly.

In detail, in a case when the subject gas to be measured is the ammonia of the pKa of about 9.3, since the pH indicator having the pH 9.3 band is used, the thymol blue provided with color changes in the range of about pH 8.0 and about pH 9.6 may be used. As to measure the thin density of the ammonia under ppm unit, the changes of colors are needed to be present even with a small change in the pH, and thus, in the case as such, the cresol red provided with color changes in the range of about pH 7.0 and about pH 8.8 or the bromothymol blue provided with color changes in the range of about pH 6.0 and about pH 7.6 may be used.

When the inside the sensor housing 152 is filled by mixing the proper pH indicator 155 and the solution 154 according to the subject gas, the subject gas that is present at outside atmosphere is introduced into an inside the sensor housing 152 as to induce the pH change of the solution 154, and according to the pH change, the color of the pH indicator 155 is changed. Thus, by structuring the sensor housing 152 by use of transparent material, a user may be able to determine the density of the subject gas by observing the color change from an outside.

The density of the subject gas as such is related to the status of foods, and thus by observing the color changes of the sensor module 150 the status of the accommodated foods may be acknowledged.

The sensor module may be positioned at the food accommodation unit 130 as to introduce and measure the density of the subject gas. That is, the sensor module 150 is provided at an inside the storage container 100, and is coupled to an inner side surface of the container cover 120 while being accommodated at the coupling member 160.

In addition, as for a user to determine the status of the foods by observing the color changes of the sensor module 150, the sensor module 150 may be provided as to display the color changes of the sensor module 150 at an exterior of the container cover 120. That is, the sensor unit 140 may be installed as to display the status of the foods accommodated at the food accommodation unit 130 at an outer side surface of the container cover 120.

As described above, the storage container 100 includes the display unit 124, and the display unit 124 may be disposed at an outer side surface of the container cover 120. In detail, as for the color changes of the sensor module 150 to be observed from an outer side of the storage container 100, the display unit 124 may be provided with transparent material. As illustrated on FIG. 3 and FIG. 4, the display unit 124 is provided at an outer side surface of the container cover 120 such that the sensor module 150 is projected through.

In addition, the color samples 126 having illustrated with the colors of the sensor module 150 may be provided at an outer side surface of the container cover 120 while the colors correspond with respect to the status of the each food accommodated at the food accommodation unit 130. The color samples 126 may be adjacently disposed with respect to the display unit 124 such that a user may easily compare the colors of the sensor module 150 with the color samples 126.

As for the color changes of the sensor module 150 to be illustrated at the display unit 124, at least a portion of the container cover 120, as well as the sensor cover 180, may be provided with transparent material. Thus, the sensor unit 140 is detachably coupled to an inner side of the container cover 120, and may be able to display the status of the foods at an outer side of the container cover 120.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A storage container, comprising:

a container body;

a container cover coupled to the container body;

a sensor module disposed on at least one of the container body and the container cover, the sensor module configured to measure gas generated by food accommodated in the container body; and a coupling member provided as to accommodate at least a portion of the sensor module, and detachably coupled to at least one of the container body and the container cover so that, when the coupling member is accommodating the at least a portion of the sensor module and is coupled to the at least one of the container body and the container cover, the coupling member is detachable from the at least one of the container body and the container cover while continuing to accommodate the at least a portion of the sensor module, wherein a food accommodation unit is formed as the container body and the container cover are coupled with respect to each other, and the coupling member is coupled to an inner side surface of the at least one of the container body and the container cover such that the sensor module is positioned at the food accommodation unit, wherein the sensor module is coupled to an inner side surface of the container cover, and at least a portion of the sensor module is provided at an inside of the container body, wherein the coupling member is rotatably attached to or detached from the at least one of the container body and the container cover, and wherein the at least one of the container body and the container cover comprises a concavo-convex container structure such that the coupling member is rotated and then fixed to a predetermined position, and the coupling member comprises a concavo-convex coupling structure corresponding to the concavo-convex container structure.

2. The storage container of claim 1, wherein:

the coupling member comprises a coupling protrusion extending in the shape of a spiral.

3. The storage container of claim 2, wherein:

the at least one of the container body and the container cover comprises a guide protrusion configured to guide the coupling protrusion.

4. The storage container of claim 1, wherein:

the at least one of the container body and the container cover comprises a coupling accommodation unit, and the coupling member comprises a coupling insertion unit being inserted into the coupling accommodation unit.

5. The storage container of claim 4, wherein:

the coupling insertion unit comprises a coupling protrusion extendedly formed in the shape of a spiral, and the coupling accommodation unit comprises a guide protrusion configured to guide the coupling protrusion such that the coupling insertion unit is rotated and then inserted into the coupling accommodation unit.

6. The storage container of claim 4, wherein:

a sensor accommodation unit at which the sensor module is accommodated is provided at an inner side of the coupling insertion unit.

7. The storage container of claim 1, wherein:

the coupling member comprises a sensor accommodation unit at which the sensor module is accommodated, and as to protect the sensor module accommodated at the sensor accommodation unit, the coupling member further comprises a sensor cover coupled to one side of the sensor accommodation unit.

8. The storage container of claim 7, wherein:

the sensor cover is coupled to one side of the sensor accommodation unit, such that the sensor module is fixed to the sensor accommodation unit.

9. The storage container of claim 1, wherein:

the sensor module is, together with the coupling member, attached to or detached from the at least one of the container body and the container cover.

10. The storage container of claim 1, wherein:

a sealing member is disposed in between the at least one of the container body and the container cover and the coupling member.

11. The storage container of claim 1, wherein:

the sensor module is configured to change a color based on the gas measured, and the color of the sensor module is displayed through at least one of the container body and the container cover.

12. The storage container of claim 11, further comprising color samples to display colors indicating a condition of the food and to be compared with the color of the sensor module.

13. The storage container of claim 11, wherein:

at least a portion of the at least one of the container body and the container cover is transparent such that the color of the sensor module is displayed therethrough.

14. A storage container, comprising:

a container body;

a container cover coupled to the container body as to form a food accommodation unit; and a sensor unit configured to measure gas generated by food being accommodated in the food accommodation unit, and detachably coupled to one side of the container cover, wherein the sensor unit is detachably coupled to an inner side surface of the container cover such that the sensor unit is positioned at the food accommodation unit, and wherein the sensor unit is coupled to an inner side surface of the container cover, and at least a portion of the sensor unit is provided at an inside of the container body, a coupling member provided as to accommodate at least a portion of the sensor unit, wherein the coupling member is rotatably attached to or detached from the container cover, and the container cover comprises a concavo-convex container structure such that the coupling member is rotated and then fixed to a predetermined position, and the coupling member comprises a concavo-convex coupling structure corresponding to the concavo-convex container structure.

15. The storage container of claim 14, wherein:

the sensor unit comprises a sensor module configured to change a color based on the gas measured.

16. A storage container, comprising:

a container body;

a container cover coupled to the container body;

a settling member fixed to at least one of the container body and the container cover;

a sensor module configured to measure gas generated by food accommodated in the container body; and a coupling member provided as to accommodate at least a portion of the sensor module, wherein the coupling member is detachably coupled to the settling member so that, when the coupling member is accommodating the at least a portion of the sensor module and is coupled to the settling member, the coupling member is detachable from the settling member while continuing to accommodate the at least a portion of the sensor module with the settling member remaining fixed to the at least one of the container body and the container cover, wherein a food accommodation unit is formed as the container body and the container cover are coupled with respect to each other, and the coupling member is coupled to an inner side surface of the at least one of the container body and the container cover such that the sensor module is positioned at the food accommodation unit, and wherein the sensor module is coupled to an inner side surface of the container cover, and at least a portion of the sensor module is provided at an inside of the container body, wherein the coupling member is rotatably attached to or detached from the at least one of the container body and the container cover, and the at least one of the container body and the container cover comprises a concavo-convex container structure such that the coupling member is rotated and then fixed to a predetermined position, and the coupling member comprises a concavo-convex coupling structure corresponding to the concavo-convex container structure.

* * * * *